US007168395B2

(12) United States Patent
Engdahl

(10) Patent No.: US 7,168,395 B2
(45) Date of Patent: Jan. 30, 2007

(54) SUBMERGED COMBUSTION LNG VAPORIZER

(76) Inventor: Gerald E Engdahl, 1425 Oxford La., Wheaton, IL (US) 60187

( * ) Notice: Subject to any disclaimer, the term of this patent is extended or adjusted under 35 U.S.C. 154(b) by 200 days.

(21) Appl. No.: 10/961,619

(22) Filed: Oct. 8, 2004

(65) Prior Publication Data

US 2005/0092263 A1 May 5, 2005

Related U.S. Application Data

(60) Provisional application No. 60/516,845, filed on Nov. 3, 2003, provisional application No. 60/511,827, filed on Oct. 16, 2003.

(51) Int. Cl.
*F22B 1/02* (2006.01)

(52) U.S. Cl. ..... 122/31.1; 122/31.2; 126/360.2

(58) Field of Classification Search ..... 122/31.1, 122/31.2, 33; 126/360.2
See application file for complete search history.

(56) References Cited

U.S. PATENT DOCUMENTS 4,308,855 A * 1/1982 Schallert ..... 126/360.2
5,735,235 A * 4/1998 Li ..... 122/1 R
5,799,620 A * 9/1998 Cleer et al. ..... 122/31.2
6,164,247 A * 12/2000 Iwasaki et al. ..... 122/31.1
6,338,337 B1 * 1/2002 Panz et al. ..... 126/360.2
6,367,429 B2 * 4/2002 Iwasaki et al. ..... 122/31.1

* cited by examiner

*Primary Examiner*—Gregory Wilson

(57) ABSTRACT

This invention discloses a method and device for vaporizing LNG with a submerged combustion vaporizer. The submerged combustion LNG vaporizer uses spiral tube heat transfer circuits and a submerged combustion heat source for vaporizing LNG. The submerged combustion heat source has a unique low submergence heat and mass transfer arrangement for heating circulation water.

5 Claims, 2 Drawing Sheets

SUBMERGED COMBUSTION LNG VAPORIZER

RELATED APPLICATIONS

This application claims domestic priority from provisional application Ser. No. 60/516,845, SPIRAL TUBE LNG VAPORIZER filed Nov. 3, 2003 and provisional application Ser. No 60/511,827, SUBMERGED COMBUSTION WATER HEATER filed Oct. 16, 2003, the entire disclosures of which are incorporated herein by reference. Engdahl U.S. patent application SPIRAL TUBE LNG VAPORIZER filed on Oct. 8, 2004 and Engdahl U.S. patent application SUBMERGED COMBUSTION WATER HEATER filed on Oct. 8, 2004 are incorporated herein by reference.

FIELD OF THE INVENTION

The present invention relates generally to vaporizing liquefied natural gas (LNG). More specifically, the present invention relates to an effective submerged combustion heat source and heat transfer surface area apparatus and method to vaporize LNG.

BACKGROUND OF THE INVENTION

Liquefied natural gas is stored at many locations throughout the world. The LNG is used when a local source of natural gas is not available or as a supplement to local and regional sources. Liquefied natural gas is typically stored at low pressure in the liquid state at cold temperatures. The LNG is usually pumped to a pressure that is slightly above the pressure of the natural gas distribution pipeline. The high pressure liquid is vaporized and sent to the pipeline. The vaporizers can use a fired heat source or use an energy efficient source of heat such as sea water or river water.

The submerged combustion LNG vaporizer (SCV) is a fired heat source type vaporizer used in LNG service. The conventional SCV includes a heat transfer coil installed in a liquid bath. The conventional vaporizer is equipped with submerged combustion burners firing into the liquid bath. The products of combustion are discharged into the bath. The discharge location is generally at a liquid submergence depth greater than two feet. The burner system includes a large high horsepower blower for providing combustion air. The submerged combustion burner provides heat, circulation, and turbulence for heat transfer.

There are many patents describing submerged combustion heat exchangers. The patents describe submerged pressurized products of combustion being bubbled through various combinations of holes and weirs to contact and heat water. The products of combustion are at a pressure sufficiently high to overcome the submergence depth. Deeper submergence depths require larger and higher horsepower combustion air blowers. In an application where the burner assembly discharges into water with an equivalent depth of 48 inches, the blower discharge pressure would need to be 48 inches water column plus the additional pressure drop of the system.

The submerged combustion heat exchanger disclosed in U.S. Pat. No. 3,368,548 utilizes submerged combustion burners firing into a heat exchange liquid bath containing a serpentine coil heat exchanger. The products of combustion from the high back pressure burners are used to provide heat exchanger liquid circulation within the bath for heat transfer with the serpentine coil.

In U.S. Pat. No. 3,138,150 a single burner discharges into a submerged down comer. The action of the products of combustion provides the heat transfer liquid upward circulation around a heat transfer coil.

U.S. Pat. No. 3,368,548 and 3,138,150 are typical of several submerged combustion heat exchangers where burners firing into a fluid provide fluid circulation around some type of heat transfer surface area.

These patents do not teach or suggest the products of combustion and water flow arrangement of this disclosure nor do they present the arrangement used to contact the products of combustion with the water flow nor do they teach the effective heat transfer arrangement to vaporize LNG as taught in this specification.

OBJECTIVES

Several objectives of this patent follow:

To provide a high thermal efficiency system for vaporizing LNG.

To provide an effective heat transfer arrangement to reliably vaporize LNG.

To provide a submerged combination system which operates with low combustion gas back pressure.

To provide a high capacity vaporizing system.

To provide a single burner vaporizing system.

To provide a vaporizer operating with external heat sources.

To provide a SCV operating with external heat sources and the submerged combustion heat source.

To provide an arrangement with less potential for apparatus vibration.

To provide a burner/blower system with low installed horsepower.

To provide a submerged combustion vaporizer meeting air quality regulations.

To provide a vaporizer with installation flexibility.

To provide a system which can be quickly and easily started and shutdown.

To provide a vaporizer where the spacing of the colder heat transfer tubes containing LNG can be configured to accommodate icing.

To accommodate the heating and vaporizing of many cold fluids.

To provide a vaporizer where the products of combustion do not impinge or contact the LNG heat transfer surface area.

To provide a vaporizer with provisions for an interstage manifold separator.

SUMMARY OF THE INVENTION

In accordance with one aspect of the invention, a submerged combustion method of vaporizing LNG comprising the steps of providing a source of products of combustion, providing at least one set of perforated plates and a submerged combustion inlet means, directing circulation water to flow through the submerged combustion inlet means and generally across at least one set of perforated plates, passing products of combustion through apertures in the perforated plate, contacting the circulation water and the products of combustion, heating the circulation water with the products of combustion, providing LNG heat transfer surface area, flowing LNG through the LNG heat transfer surface area, providing heated circulation water heat exchange with the LNG heat transfer surface area, and providing means to return circulation water to the submerged combustion inlet means for heating.

In accordance with another aspect of the invention, a LNG submerged combustion vaporizer comprising a source of products of combustion, at least one set of perforated plates, wherein products of combustion flow generally through apertures in at least one set of perforated plates, a submerged combustion inlet means, wherein circulation water is directed to flow through the submerged combustion inlet means and generally across the perforated plate and be heated by the products of combustion, LNG heat transfer surface area for containing and vaporizing LNG, wherein heat exchange is provided between the LNG heat transfer surface area and the heated circulation water, and at least one pump returning circulation water to the submerged combustion inlet means.

In accordance with yet another aspect of the invention, a LNG submerged combustion vaporizer comprising a combustion chamber, a burner assembly firing into the combustion chamber and producing products of combustion, at least one set of perforated plates, wherein products of combustion flow generally through apertures in at least one set of perforated plates, a submerged combustion water inlet plenum, a submerged combustion water inlet means, and a submerged combustion heated water plenum, wherein water is directed through the submerged combustion water inlet plenum and through the submerged combustion water inlet means to flow generally across the perforated plate and be heated by the products of combustion and be collected in the submerged combustion heated water plenum, at least two annular space shell plates disposed to form an annular space, wherein the submerged combustion heated water plenum communicates with the annular space, at least one LNG inlet manifold and at least one LNG outlet manifold, rows of spiral tube heat transfer circuits for containing and vaporizing LNG being positioned generally within the annular space and communicating with at least one LNG inlet manifold, a water outlet plenum communicating with the annular space, wherein the water outlet plenum communicates with the submerged combustion water inlet plenum, and at least one pump circulating water from the water outlet plenum to the submerged combustion water inlet plenum.

In accordance with still another aspect of the invention, a LNG submerged combustion vaporizer comprising a submerged combustion heat source further comprising: a products of combustion heat source, at least one set of perforated plates, a submerged combustion water inlet means directing water to flow generally across at least one set of perforated plates, wherein the products of combustion are directed generally through apertures in the perforated plate to heat the water, LNG vaporizer heat transfer area further comprising: an annular space flow arrangement, a vaporizer water inlet plenum communicating with the annular space, at least one LNG inlet manifold and at least one LNG outlet manifold, rows of spiral tube heat transfer circuits for containing and vaporizing LNG being positioned generally within the annular space and communicating with at least one LNG inlet manifold, a vaporizer water outlet plenum communicating with the annular space, and at least one pump circulating water from the LNG vaporizer heat transfer area to the submerged combustion heat source.

DETAILED DESCRIPTION OF THE INVENTION

The present invention discloses a submerged combustion vaporizer which differs from conventional submerged combustion vaporizers. The heat source is a unique products of combustion and water flow arrangement providing the heat and mass transfer surface area contact between the water and the products of combustion. An effective heat transfer arrangement provides the surface area for vaporizing the LNG using the submerged combustion heat source. The submerged combustion vaporizer has high efficiency and many advantages.

Figure 1:
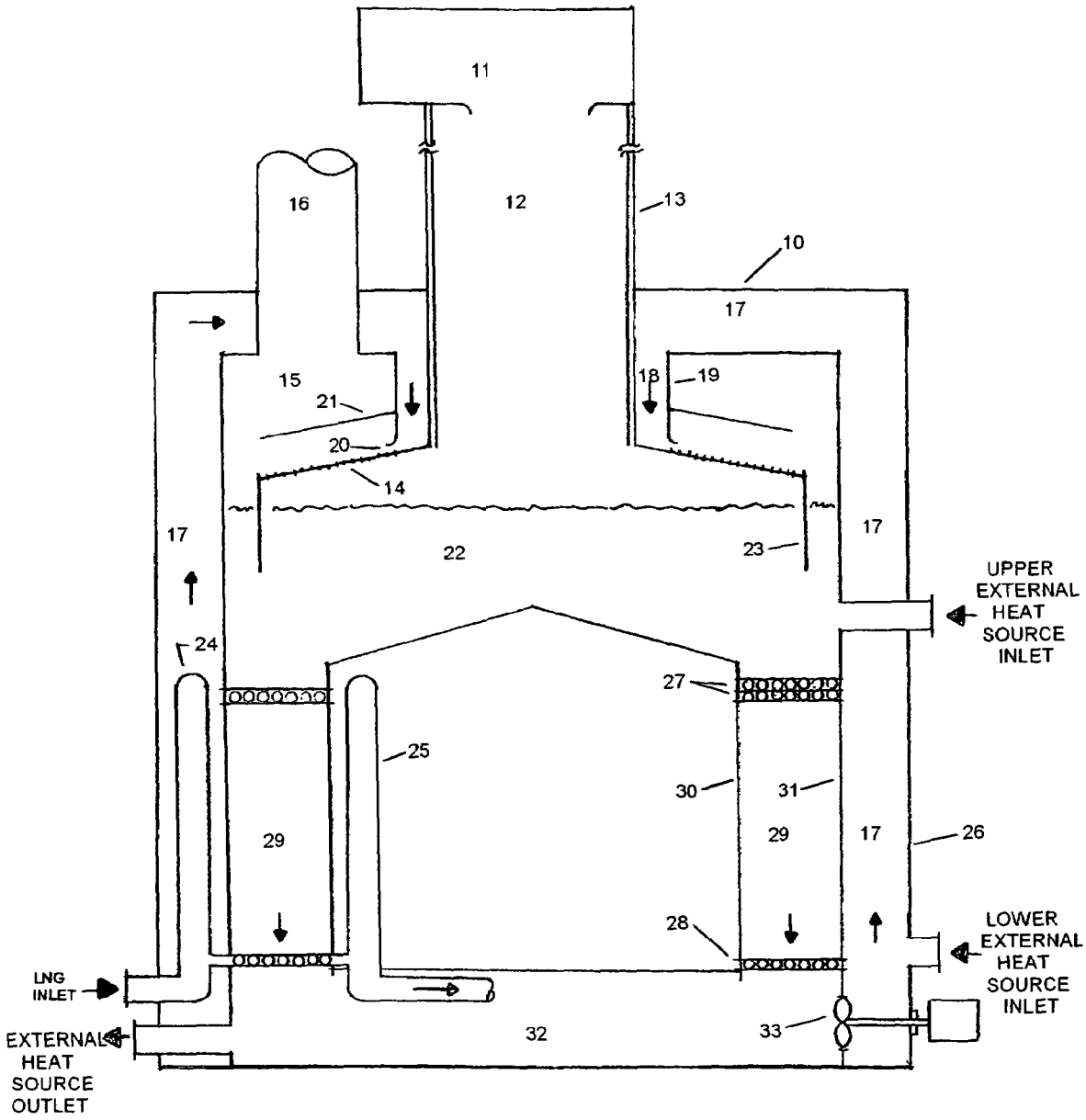
FIG. 1 is an elevation cross section of a cylindrical submerged combustion vaporizer.

The submerged combustion vaporizer apparatus 10 is shown in FIG. 1. The submerged combustion heat source of apparatus 10 is shown in the upper portion of FIG. 1 and illustrates Provisional Patent 60/511,827 SUBMERGED COMBUSTION WATER HEATER. The lower portion of FIG. 1 includes the LNG heat transfer surface area. A pump circulates circulation water from the lower LNG heat transfer surface area to the submerged combustion heat source for heating.

The submerged combustion heat source of apparatus 10 includes the burner assembly 11 firing into the combustion chamber 12 producing products of combustion gases. The burner assembly 11 includes the combustion air blower and motor. The combustion chamber 12 is of sufficient diameter and length to obtain the required combustion efficiency and required emissions in combination with the burner assembly. An outer cooling jacket 13 provides an annular space surrounding the combustion chamber. Water is directed to the cooling jacket annular space for cooling the combustion chamber wall. The combustion chamber cooling water flows through the annular space and discharges into the combustion chamber. A portion of the combustion chamber cooling flow can evaporate and produce steam. Means can be provided to increase the portion and quantity of combustion chamber cooling flow being evaporated. The resulting vaporized water will combine with the products of combustion. As an alternate to discharging directly into the combustion chamber, the discharge flow could be directed to another location. The composition of the term "products of combustion" as provided in this disclosure will include water vapor produced during the combustion process and can include additional water vapor from other sources. The burner assembly 11 and combustion chamber 12 can include thermal insulation. The products of combustion exit the combustion chamber 12 and flow through apertures in perforated plate 14 in a generally ascending manner contacting water flowing across perforated plate 14. The perforated plate 14 is installed with a slope as shown or can be installed horizontally, or at other positions. The length of the perforated plate is sized to provide heat and mass transfer surface contact area between the flowing water and the combustion products and sized for other considerations. The perforated plate can also be plate or tray arrangements with apertures or other openings. Another set of perforated plates can be included stacked above the other to provide additional contact area (not shown). The stacked plates are arranged such that the products of combustion generally flow through each plate. The combustion products exit the perforated plate 14 and are collected in flue plenum 15. The flue stacks 16 connect to flue plenum 15. The flue stacks 16 discharges the flue products to atmosphere. A water spray system (not shown) can be located in flue plenum 15 to increase the efficiency of the system and provide additional benefits.

In FIG. 1 the circulation water to be heated enters the submerged combustion heat source via water inlet plenum 17. The water flows upward within inlet plenum 17 to horizontal inlet plenum 17 and into an annular down comer 18 The down comer 18 is formed by down comer plate 19 surrounding the combustion chamber. The water exits down comer 18 through an orifice opening 20. The orifice opening 20 can be adjustable. Orifice opening 20 is the opening between down comer plate 19 and perforated plate 14. Additional orifice openings can be provided to accompany additional sets of stacked perforated plates. The water exiting orifice opening 20 flows as a high velocity stream generally across perforated plate 14 contacting products of combustion flowing through apertures in perforated plate 14. Heat and mass transfer contact is provided between the streams. A small portion of the water may flow through holes in perforated plate 14. Annular plate 21 connects to down comer plate 19. Annular plate 21 is located to provide a flow passage space between plate 21 and perforated plate 14. Annular plate 21 can also be provided as a defector plate with holes. The flow passage space between the plates provides area for heat and mass transfer contact between the products of combustion and the water to be heated as the water flows outward in a generally radial direction. The water flowing generally across perforated plate 14 discharges into heated water plenum 22. Baffle plate 23 prevents products of combustion from bypassing perforated plate 14. Baffle plate 23 provides a liquid seal to contain the products of combustion. Baffle plate 23 can be provided with adjustment means. Means are provided to direct a stream of water toward or along baffle plate 23 for cooling of the plate (not shown). Baffle plate 23 can be positioned to provide a depth adjustment for water flowing over perforated plate 14.

After a period of operation the water pH can decline. The addition of chemicals to maintain the proper water quality may be required. The combustion reaction produces water. At cooler submerged combustion operating temperatures the produced water is retained in the submerged combustion vaporizer. The quantity of water in the vaporizer will increase at a low rate. The submerged combustion system operating at warmer temperatures will have a net decrease in water quantity in the submerged combustion apparatus as a result of water leaving the submerged combustion apparatus via the flue stack. The addition or loss of water in the vaporizer results in level changes in the apparatus water level. Control means (not shown) are provided to maintain plenum 22 water level within operating limits. A baffle arrangement can be included in plenum 22 to help inhibit wave action. The heated water flows from outlet water plenum 22 to the LNG heat transfer surface area. The patent configuration provides ample heat and mass transfer area between the products of combustion and water. The area includes the heated water plenum 22 surface, the perforated plate 14, the zone above perforated plate 14, optional spray systems and other areas where the water is being heated with products of combustion.

The lower portion of FIG. 1 illustrates Provisional Patent 60/516,845 SPIRAL TUBE LNG VAPORIZER. The lower portion of FIG. 1 shows the heat transfer surface area for vaporizing LNG. Included is LNG inlet manifold 24, LNG vapor outlet manifold 25, vaporizer containment vessel 26, rows of heat transfer spiral tube circuits 27, support rods 28, annular space 29, inner annular space shell plate 30, outer annular space shell plate 31, and water outlet plenum 32. The LNG inlet manifold receives LNG from pumps, generally at high pressure. The inlet end of a heat transfer spiral tube circuit 27 connects and communicates with inlet manifold 24. The outlet end of the spiral tube circuit connects and communicates with LNG outlet manifold 25. Multiple rows of vertically stacked spiral tube circuits 27 are connected to the LNG manifolds. The spiral tube circuits can also be installed with an interstage manifold. A portion of the spiral tube circuits would connect to an inlet manifold on one end and connect to an interstage manifold on the other end. Another portion of the spiral tube circuits would connect to the interstage manifold on one end and connect to an outlet manifold on the other end. The interstage manifold can be designed as a separator to collect and remove hydrocarbon liquids from the send out stream. The interstage manifold separator can help provide LNG send out heating value control. Control can be included on the interstage manifold to obtain the required separation. The water flow arrangement would be as shown in FIG. 1.

The spiral tube circuits 27 containing flowing LNG provide heat transfer area for vaporizing the LNG. The heat transfer spiral tube circuits can be provided with inlet orifices for distribution and core busters for increased heat transfer. Considerable vaporizer surface area can be provided by the multiple rows of spiral tube circuits. High LNG flows can be vaporized in a compact single unit.

Each spiral tube circuit 27 row rests on several support rods 28. The support rods 28 span the annular space 29. The annular space 29 is the annular space between inner annular space shell plate 30 and. outer annular space shell plate 31. The annular space 29 is positioned within the SCV containment vessel 26. The heated water plenum 22 communicates with the upper part of annular space 29. The water outlet plenum 32 communicates with the lower part of annular space 29. The circulation water flowing through the annular space is in cross flow heat exchange contact with LNG flowing through the spiral tube circuits.

Holes are provided in annular space shell plate 30 and annular space shell plate 31 to accept support rods 28. Support bars and other types of devices can be used to support the spiral tube circuits. The spiral tube circuits 27 are shown in the aligned position in FIG. 1. Each tube within the spiral tube circuit is placed generally vertically above each tube in the row below. The spiral tube circuits can also be placed in the staggered position. In the staggered position each tube within the spiral tube circuit is placed generally above the gap in the row below. The vertical spacing of support rods 28 is slightly larger than the sum of the outside diameter of a heat transfer tube plus the diameter of a support rod, providing vertical clearance such that movement of the tubes is not restricted by the above support rods. The rows of spiral tube circuits are not supported by tubes in the row below. Each row is supported by its system of support rods. The tube is not restricted from moving as it is cooled down or warmed up. Independent movement is provided for each spiral tube circuit row. Individual heat transfer tubes and circuits can cool down or warm up at different rates without high thermal stresses. The tube movement is generally in a radial direction. In some applications that portion of the spiral tube circuit nearest the cold inlet manifold will ice. The tube pitch of the tubes in a spiral tube circuit is adjusted in the design as required to accommodate the tube ice layer on the colder part of the spiral circuit. The tube pitch can be adjusted to allocate heating medium flow.

A stand-off bar (not shown) is positioned over tubes within a spiral circuit where needed to maintain a minimum gap width between the tubes. The stand-off bars are positioned over each spiral tube circuit row as it is fabricated into the annular space. The tube pitch of tubes within a spiral tube circuit row may vary, requiring several models of stand-off bar. Each stand-off bar model would provide the required minimum gap width. During operation, water circulates around all tubes in the spiral tube circuit to provide proper heat transfer performance. The water flowing through the annular space is in cross flow heat exchange contact with LNG flowing through the plurality of spiral tube circuits. Baffles which could induce water flow dead spots are not required.

The impeller of water pump 33 is positioned in water outlet plenum 32. Water pump 33 circulates the cooler circulation water from outlet plenum 32 to the submerged combustion heat source inlet plenum 17. The pump 33 can be an axial flow pump, propeller pump, a centrifugal pump, ejector pump, or similar device for circulating large liquid flows at low head pressures. The water pump can be provided with a variable speed drive. The pump 33 can be positioned as shown in FIG. 1 or positioned external to SCV device 10.

The SCV can be configured with several heat source arrangements and several LNG heat transfer surface area arrangements. The submerged combustion heat source can be located above the heat transfer area or adjacent to the LNG heat transfer surface area. The heat transfer surface area arrangements can include a spiral tube arrangement, a helix arrangement, a serpentine arrangement, or a shell and tube exchanger. The configuration of Engdahl patent application Ser. No. 10/869,086 for a RELIABLE LNG VAPORIZER can provide the LNG heat transfer area. Piping may be required as extensions of the water plenums to connect the various LNG heat transfer surface area arrangements to the submerged combustion heat sources.

The SCV can be configured to use an external heat source. The external heat source could be warm water from a power plant, seawater, cooling tower water or other sources. Several external heat source connections are included in the SCV shown on FIG. 1. The FIG. 1 submerged combustion vaporizer can operate with or without an external heat source. It can operate with an external heat source providing a portion of the duty and the submerged combustion burner providing part of the duty. The piping and control systems for operation using an external heat source are not included on FIG. 1. Table 1 includes information on several SCV operating modes.

TABLE 1

| OPERATING MODE | SCV PUMP FLOW GPM | SC HEAT % | LNG AREA FLOW GPM | HEAT SOURCE INLET LOCATION | LNG AREA INLET TEMP. | LNG AREA OUTLET TEMP. | EXTERNAL HEAT SOURCE INLET TEMP. | EXTERNAL HEAT SOURCE OUTLET TEMP. | EXTERNAL HEAT SOURCE FLOW GPM |
|---|---|---|---|---|---|---|---|---|---|
| BASIC SCV | 10000 | 100 | 10000 | NOT REQUIRED | 85 | 75 | — | — | 00 |
| ALL EXTERNAL HEAT | NONE | 0 | 10000 | UPPER | 85 | 75 | 85 | 75 | 10000 |
| 50% EXTERNAL HEAT | 5000 | 50 | 10000 | LOWER | 85 | 75 | 85 | 75 | 5000 |
| 50% EXTERNAL HEAT | NONE | 50 | 15000 | LOWER | 90 | 80 | 85 | 80 | 15000 |

NOTE 1: TABLE 1 IS AN EXAMPLE OF SEVERAL FIG. 1 AND FIG. 2 SCV OPERATING MODES. OTHER OPERATING MODES ARE POSSIBLE. TABLE 1 USES ASSUMED SETS OF CONDITIONS. PIPING AND CONTROL SYSTEM MODIFICATIONS AND APPROPRIATE APPARATUS MODIFICATIONS WILL BE REQUIRED TO FIT A SPECIFIC APPLICATION AND SET OF CONDITIONS.

Figure 2:
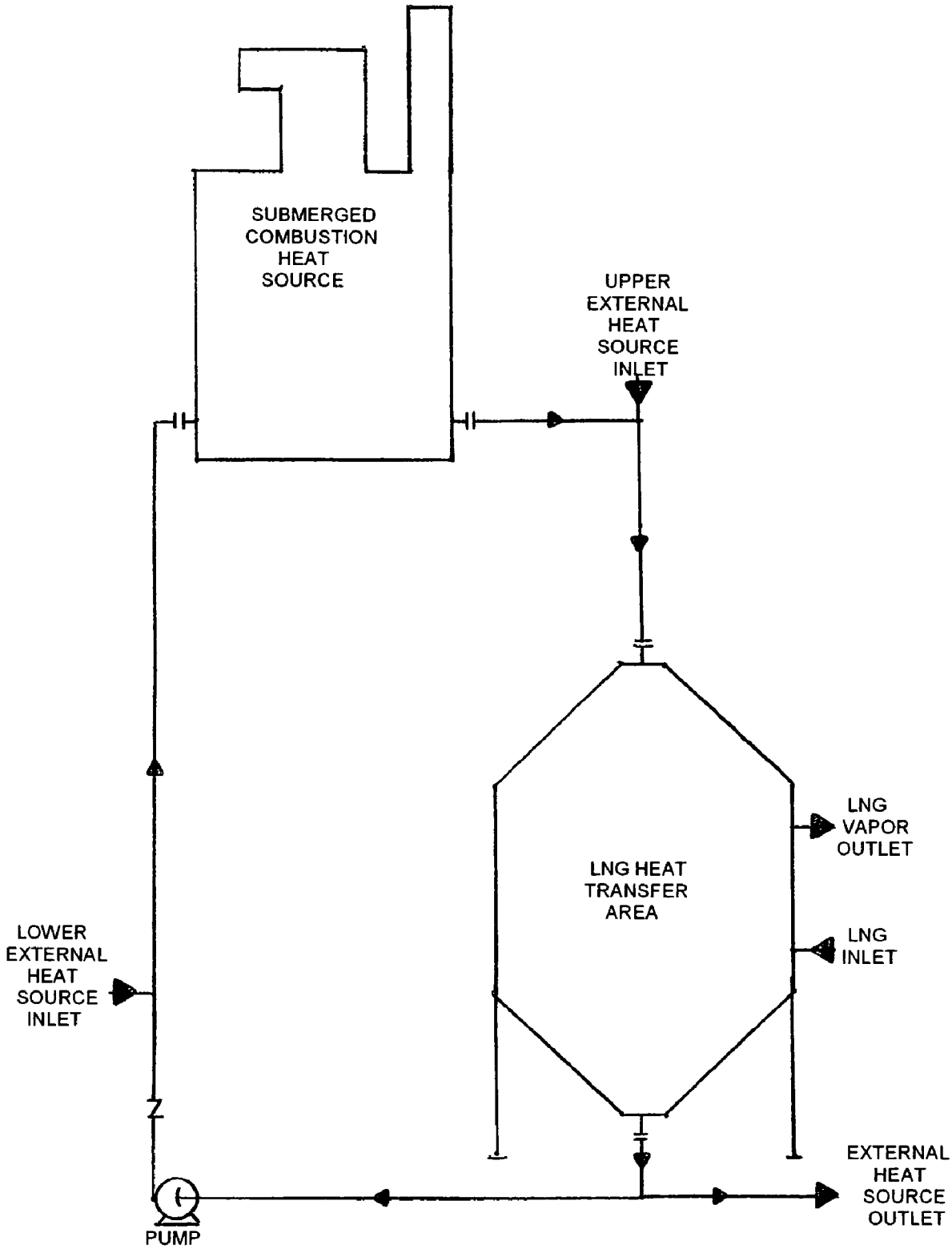
FIG. 2 is a sketch of a LNG submerged combustion vaporizer with the submerged combustion heat source located remote from the LNG heat transfer area.

FIG. 2 is a sketch of a LNG submerged combustion vaporizer. with the submerged combustion heat source located remote from the LNG heat transfer surface area. The pump circulates heating medium exiting the LNG heat transfer area to the submerged combustion heat source. The FIG. 2 submerged combustion vaporizer can operate with or without an external heat source. It can operate with an external heat source providing a portion of the duty and the submerged combustion burner providing part of the duty. The FIG. 2 system includes two external heat source inlets and an outlet external heat source connection. The FIG. 2 system would be appropriate for vaporizer operation with a clean external heat source heating medium and with an external heat source heating medium containing particulate matter. Seawater and cooling tower water are external heat sources containing some particulate matter. The FIG. 2 submerged combustion heat source would be similar to the submerged combustion heat source shown in the upper portion of FIG. 1. The spiral tube LNG vaporizers disclosed in Engdahl U.S. patent application SPIRAL TUBE LNG VAPORIZER would be typical of the vaporizers providing LNG heat transfer area for the FIG. 2 system. The vaporizer shown in FIG. 10 of the SPIRAL TUBE LNG VAPORIZER application could be used when operating with a clean external heat source and with an external heat source containing particulate matter. The FIG. 10 vaporizer of the SPIRAL TUBE LNG VAPORIZER application would typically include an annular space flow arrangement, at least one vaporizer heating medium entrance, a vaporizer water inlet plenum communicating with the annular space and communicating with a vaporizer heating medium entrance, at least one LNG inlet manifold and at least one LNG outlet manifold, a plurality of rows of spiral tube heat transfer circuits for containing and vaporizing LNG being positioned generally within the annular space and communicating with at least one LNG inlet manifold and at least one LNG outlet manifold, and a vaporizer heating medium outlet plenum communicating with the annular space. The spiral tube LNG vaporizer of FIG. 10 of the SPIRAL TUBE LNG VAPOR- IZER application is configured to maintain heating medium turbulence and maintain particulate matter in suspension if particulate matter is present in the heating medium. The vaporizer operating modes indicated in Table 1 are also applicable to the FIG. 2 system. Other heat exchanger configurations can provide the LNG heat transfer area of the FIG. 2 configuration.

The use of an external heat source can increase the energy efficiency of the SCV by reducing the burner fuel use, by reducing combustion air blower use and other considerations. The operation of the SCV system with the external heat source may be a function to the weather and other considerations. Some external heat source fluids may not be compatible with the submerged combustion heat source portion of the system. The external heat source fluids would need to be removed from the system before vaporizing with the submerged combustion heat source.

In the FIG. 1 and FIG. 2 arrangements, the products of combustion do not impinge or contact the LNG heat transfer surface area. The pump provides circulation of the water rather than the products of combustion used in traditional submerged combustion LNG vaporizers for circulation.

The SCV can include one or more of the following control functions (not shown in the figures):

- Control means for varying the LNG flow. Control means for varying the flow can include valves and variable flow pumps.
- Control means for varying the water flow. Control means for varying the flow can include valves and variable flow pumps.
- Control means to maintain water levels within operating limits.
- Burner and blower control system including temperature control.
- Providing means to control and maintain the pH of the water and solutions.

Additional operational, safety and shutdown functions are included in the SCV control systems.

The submerged combustion vaporizer can include several arrangements and variations. Variations and arrangements of the vaporizer can include one of more of the following:

- Water can be sprayed or injected into the products of combustion resulting in the production of steam and cooling of the products of combustion.
- Baffles can be positioned in the heated water plenum to assist in the removal of bubbles and entrainment in the heated water.
- Providing means to reduce the quantity of liquid droplets in the products of combustion leaving via the stacks.
- Providing means to improve the air quality emissions from the heater.
- Providing several LNG inlet and outlet manifolds.
- Providing one or more LNG interstage manifolds.
- Providing two heating medium annular space passes.
- Providing refractory insulation on the combustion chamber.
- Several types of spiral tube circuit annular space supports including support rods, support tubes, support bars and heating medium bar baffles.
- The SCV can be configured to operate with fluids other than water.
- The containment position can be vertical, horizontal, at a slant or at other positions.
- Several pumps can be provided to circulate the heating medium.
- Contacting the products of combustion with a water spray before the products of combustion are vented to atmosphere to increase the heater efficiency.

The SCV has design flexibility and scalability to adapt to the requirements of the application. Other shapes can also be utilized to configure the SCV. They may not be as scaleable as the cylindrical arrangement or provide the uniform distribution obtainable with the cylindrical arrangement. The heater has installation flexibility. It can be installed below grade, above grade or partly below grade. It can be located onshore and on offshore platforms.

The burner assembly is located in a dry area firing into a large combustion chamber. The large combustion chamber can accommodate a single high capacity, high efficiency, low horsepower, low pressure burner assembly. The low pressure and low submergence in the contact zone and other features of the submerged combustion system reduce the potential for apparatus vibration. The combustion chamber can also be configured to accommodate multiple burners. The unique water and products of combustion flow and contact arrangement permits the use of conventional low backpressure type burner assemblies. The burner assembly backpressure would generally be less than one pound per square inch.

The conventional burner assembly used in the invention can more readily meet air quality regulations than the high back pressure submerged combustion burner system. Several means are available to reduce the products of combustion emissions from the submerged combustion burner system. A high performance burner can provide reduced emissions. A further reduction can be obtained by recirculating products of combustion to the burner assembly to reduce the SCV emissions. A products of combustion stream from the flue plenum or flue stack can be recirculated to the burner. The high efficiency submerged combustion heat source produces cool products of combustion in the flue plenum and the flue stack. The cool products of combustion can be recirculated to the burner system. Some applications may require that the cool products of combustion be heated before being recirculated to the burner. The cool flue gas can be heated by indirect heat exchange with the hot products of combustion. In another system the cool flue gas can be heated by blending a portion of the hot products of combustion with the cool flue gas to produce the required gas temperature for recirculation. Another system would use cool products of combustion or flue gas from an external source to lower the SCV emissions. The external source of flue gas could be a gas turbine or another type of fired facility. The arrangement using an external flue gas source could increase the overall energy efficiency of the combined system.

At start-up, the SCV water flow is established before the burner is started. It is not necessary for the combustion air blower to displace water from a portion of the apparatus before the burner is fired. Many existing submerged combustion systems require the removal of water quantities from some regions of the apparatus increasing the startup time. The time required for the SCV burner start-up is low. Start-up is quick and easy. The pressure drop in the apparatus water circuit is low.

The spiral tube circuits utilized in this disclosure are tubes wound in a spiral in a flat horizontal plane. Spiral winding vendors and manufactures refer to this shape as a flat spiral.

The steps of manufacturing the LNG vaporizer spiral tube heat transfer area include:

- Forming heat exchange tubes into spiral tube circuits.
- Fabricating annular space shell plates with support rod holes.

Preparing support rods, and LNG manifolds.

Fabricating a spiral tube circuit row to include positioning several support rods through holes in at least one annular space shell plate, securing support rods, placing a spiral tube circuit row on support rods, connecting one end of the spiral tube circuit to a manifold and connecting the other end of the spiral tube circuit to a manifold.

Fabricating multiple spiral tube circuit rows each in succession to form an annular space assembly.

Fabricating heating medium plenums.

Position and fabricate the annular space assembly and heating medium plenums into an outer containment vessel.

The present invention is described as a LNG vaporizer which inherently is meant to include the heating and vaporization of liquid and the heating of vapor. The vaporizer can be used to heat and vaporize other fluids in addition to LNG. Other fluids can be heated in the vaporizer.

Features

Several features of this invention follow:

The unique products of combustion and water flow arrangements provide an effective means for heat and mass transfer contact between water and the products of combustion.

The burner start-up sequence can proceed without the combustion air blower displacing water.

The submerged combustion system can be quickly started and shutdown.

The combustion system is configured to operate with low back pressure. The combustion chamber and burner operate at low pressure. The combustion air blower has low installed horsepower.

The submerged combustion system facilitates the installation of high efficiency, high capacity, single burners.

The low backpressure, low submergence submerged combustion system has less potential for apparatus vibration.

The low pressure burner/combustion chamber arrangement can more readily meet air quality regulations.

The vaporizer has installation flexibility. It can be installed below grade, above grade or partly below grade. It can be located onshore and on offshore platforms.

The pressure drop of the heating medium fluid being circulated in the SCV is low.

The SCV includes effective heat transfer arrangements to reliably vaporize LNG.

The flexible spiral tube heat transfer circuit can accommodate differential thermal movement.

The SCV provides high capacity LNG vaporization means.

The SCV system can operate using energy efficient external heat sources and the submerged combustion heat source to provide energy for vaporizing LNG.

The SCV system can be configured to use energy efficient external heat sources such as sea water, warm water or cooling tower water to provide energy for vaporizing LNG.

The spacing of heat transfer tubes can be configured to accommodate tube icing and water flow.

Individual heat transfer tubes and circuits can cool down or warm up at different rates without high thermal stresses.

The SCV can heat and vaporize many fluids in addition to LNG.

The vaporizer provides a rugged and compact means for vaporizing LNG

The products of combustion do not impinge or contact the LNG heat transfer area.

The vaporizer can include a separator for removing hydrocarbon liquids from the LNG stream.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the apparatus may be varied substantially without departing from the spirit of the invention, and the exclusive use of all modifications which come within the scope of the appended claims is reserved.

What is claimed is:

1. A LNG submerged combustion vaporizer comprising:

a source of products of combustion;

at least one set of perforated plates; wherein products of combustion flow generally through apertures in at least one set of perforated plates;

a submerged combustion water inlet means; wherein circulation water is directed to flow through the submerged combustion water inlet means and generally across the perforated plate and be heated by the products of combustion;

LNG heat transfer surface area for containing and vaporizing LNG; wherein heat exchange is provided between the LNG heat transfer surface area and the heated circulation water; and at least one pump returning circulation water to the submerged combustion water inlet means.

2. A LNG submerged combustion vaporizer comprising:

a source of products of combustion;

at least one set of perforated plates; wherein products of combustion flow generally through apertures in at least one set of perforated plates;

a submerged combustion inlet means; wherein circulation water is directed to flow through the submerged combustion inlet means and generally across the perforated plate and be heated by the products of combustion;

LNG heat transfer surface area for containing and vaporizing LNG; wherein heat exchange is provided between the LNG heat transfer surface area and the heated circulation water;

at least one pump returning circulation water to the submerged combustion inlet means; and wherein various fluids including LNG are heated and vaporized in the vaporizer or are heated in the vaporizer.

3. A LNG submerged combustion vaporizer comprising:

a submerged combustion heat source further comprising:

a products of combustion heat source;

at least one set of perforated plates;

a submerged combustion water inlet means directing water to flow generally across at least one set of perforated plates;

wherein the products of combustion are directed generally through apertures in the perforated plate to heat the water;

LNG vaporizer heat transfer area further comprising:

an annular space flow arrangement;

a vaporizer water inlet plenum communicating with the annular space;

at least one LNG inlet manifold and at least one LNG outlet manifold;

rows of spiral tube heat transfer circuits for containing and vaporizing LNG being positioned generally within the annular space and communicating with at least one LNG inlet manifold;

a vaporizer water outlet plenum communicating with the annular space; and at least one pump circulating water to or from the LNG vaporizer heat transfer area to or from the submerged combustion heat source.

4. The vaporizer of claim 3, further comprising one or more from the group consisting of:

(a) wherein a vaporizer water inlet plenum is positioned generally concentric and symmetrical to the annular space;

(b) wherein at least one vaporizer water entrance communicates with a vaporizer water inlet plenum;

(c) wherein a vaporizer water entrance is positioned generally concentric and symmetrical to the annular space;

(d) wherein various fluids including LNG are heated and vaporized in the vaporizer or are heated in the vaporizer;

(e) wherein a spiral tube heat transfer circuit is arranged to provide substantially cross flow heat transfer;

(f) wherein products of combustion are recirculated to the source of products of combustion;

(g) wherein flue products of combustion are heated and recirculated to the source of products of combustion;

(h) wherein flue products of combustion from an external source are routed to the source of products of combustion;

(i) wherein a spiral tube heat transfer circuit is generally supported on support rods, tubes, or bars;

(j) wherein other types of heat transfer circuits are included;

(k) wherein the water is a water solution or another fluid or a fluid with particulate matter;

(l) wherein at least one external heat source inlet and at least one external heat source outlet are provided;

(m)wherein the products of combustion and an external heat source or an external heat source provides the heating duty;

(n) wherein rows of spiral tube heat transfer circuits are generally supported on support rods and the support rods for a row are positioned to provide vertical clearance between a row of spiral tube heat transfer circuits and the support rods supporting the row of spiral tube heat transfer circuits located above and allowing independent movement of each row of spiral tube heat transfer circuits;

(o) wherein the fabrication sequence includes placing a spiral tube heat transfer circuit generally within the annular space followed by placement of a successive spiral tube heat transfer circuit row;

(p) wherein the tube pitch of selected tubes within a spiral tube heat transfer circuit is adjusted to accommodate tube icing or adjusted to accommodate water flow or both;

(q) wherein an annular plate system is located above a perforated plate;

(r) wherein a portion of the water flows through apertures in the perforated plate;

(s) wherein an annular plate system provides space for heat and mass transfer surface area contact between water and the products of combustion;

(t) wherein the submerged combustion water inlet means includes a down comer and orifice opening;

(u) wherein the vaporizer is provided with an interstage manifold communicating with the heat transfer circuits.

5. A LNG submerged combustion vaporizer comprising:

a source of products of combustion;

at least one set of perforated pirates; wherein products of combustion flow generally through apertures in at least one set of perforated plates;

a submerged combustion inlet means; wherein circulation water is directed to flow through the submerged combustion inlet means and generally across the perforated plate and be heated by the products of combustion;

LNG heat transfer surface area for containing and vaporizing LNG; wherein heat exchange is provided between the LNG heat transfer surface area and the heated circulation water;

at least one pump returning circulation water to the submerged combustion inlet means; and wherein the products of combustion and an external heat source or an external heat source provides the heating duty.

* * * * *